US007735556B2

(12) United States Patent
Misselbrook et al.

(10) Patent No.: US 7,735,556 B2
(45) Date of Patent: Jun. 15, 2010

(54) METHOD OF ISOLATING OPEN PERFORATIONS IN HORIZONTAL WELLBORES USING AN ULTRA LIGHTWEIGHT PROPPANT

(75) Inventors: John Gordon Misselbrook, Calgary (CA); Russell Meyer, Calgary (CA); Darcy A. Schultz, Calgary (CA); Trevor Gordon Hayes, Calgary (CA); Quentin Shane Stang, Grand Prairie (CA)

(73) Assignee: BJ Services Company, Houston, TX (US)

( * ) Notice: Subject to any disclaimer, the term of this patent is extended or adjusted under 35 U.S.C. 154(b) by 111 days.

(21) Appl. No.: 12/048,958

(22) Filed: Mar. 14, 2008

(65) Prior Publication Data

US 2008/0271889 A1 Nov. 6, 2008

Related U.S. Application Data

(60) Provisional application No. 60/927,405, filed on May 2, 2007.

(51) Int. Cl.
*E21B 43/267* (2006.01)
*E21B 33/134* (2006.01)

(52) U.S. Cl. ..... 166/281; 166/280.1; 166/292; 166/308.1

(58) Field of Classification Search ..... None
See application file for complete search history.

(56) References Cited

U.S. PATENT DOCUMENTS

2008/0108524 A1 * 5/2008 Willberg et al. ..... 507/225
2008/0217012 A1 * 9/2008 Delorey et al. ..... 166/300

* cited by examiner

*Primary Examiner*—Zakiya W. Bates
(74) *Attorney, Agent, or Firm*—Howrey LLP

(57) ABSTRACT

An improved method for building a plug in a horizontal wellbore using a fluid pill pumped into the wellbore at the end of a fracturing treatment. The fluid pill includes a high concentration of an ultra lightweight proppant, such as a neutrally buoyant proppant or an ultra lightweight proppant mixture. The fluid pill is pumped down the wellbore until it almost reaches fractures within a zone of interest. The pumping is then ceased or reduced, allowing the fractures to partially close. The ultra lightweight proppant remains suspended within the fluid pill while stationary. The pumping is then resumed at a very slow rate or as a short pump burst, thus causing the proppant in the fluid pill to bridge off until a bridge plug is formed.

24 Claims, 2 Drawing Sheets

METHOD OF ISOLATING OPEN PERFORATIONS IN HORIZONTAL WELLBORES USING AN ULTRA LIGHTWEIGHT PROPPANT

PRIORITY

This application claims the benefit of U.S. Provisional Application No. 60/927,405 filed on May 2, 2007, entitled "METHOD OF ISOLATING OPEN PERFORMATIONS IN HORIZONTAL WELLBORES," which is hereby incorporated by reference in its entirety.

BACKGROUND OF THE INVENTION

1. Field of the Invention

The present invention, in general, relates to an improved method for building a proppant plug in a horizontal wellbore at a zone of interest and, more specifically, to utilizing a fluid pill containing a high concentration of ultra lightweight proppant in order to form a proppant plug in a horizontal wellbore.

2. Description of the Related Art

New hydrocarbon reserves are increasingly being discovered in lower quality reservoirs, particularly in North America. These lower quality reservoirs require some form of "stimulation" to increase the production of hydrocarbons from wells in these fields. Fracture stimulating a well to increase the production of hydrocarbons is common practice in the oil and gas industry. Many of these reservoirs require multiple fractures to reach economic production levels and provide effective drainage. After the casing in a zone of interest has been perforated and stimulated, it must be hydraulically isolated before any new zone of interest can be exploited. A zone is often isolated by the insertion and setting of a mechanical plug, hereinafter referred to as a bridge plug, below the zone of interest.

The purpose of the bridge plug is simply to hydraulically isolate that portion of the well from a lower portion (or the rest) of the well. The isolation of the lower zone ensures high pressure fracturing fluid pumped into the well is directed to the zone of interest. The high pressure fracturing fluid is used to fracture the formation at the open perforations in the casing. The high pressure of the fracturing fluid initiates and then propagates a fracture through the formation.

In a vertical well, a bridge plug is typically run into the wellbore using a wireline, but the use of wireline to run a bridge plug in horizontal wellbores is limited to formations that are not overly sensitive to water or excess over-displacement of fluids into the fracture. This is because in order to get the bridge plug into the horizontal wellbore, the bridge plug is connected to wireline and pumped into a horizontal wellbore. The pumping of the bridge plug into the wellbore displaces the wellbore treatment fluids into the formation, which may have an adverse affect on the hydrocarbon production of the well depending on the rock formation as well as its time sensitivity to the fracture fluid. Alternatively, coiled tubing may be used to push and set the bridge plug into horizontal wellbore to isolate a zone of interest. The use of coiled tubing to run a bridge plug is time consuming and expensive because the coiled tubing needs to be removed from the wellbore between each fracturing process in order to rig up the next bridge plug that will be run for the subsequent treatment.

In an effort to reduce time and costs, another method has been developed to isolate a zone within a horizontal wellbore. This method is to build a sand plug in the wellbore at the perforation zone such that the plug hydraulically isolates the zone from the lower portion of the wellbore. To build a sand plug, the end of the fracturing fluid includes a pill of fluid containing an elevated amount of sand or proppant in comparison to the amount of sand or proppant present in the fracturing fluid. The fluid pill is pumped into the well under the fracturing pump rate. The formation at the zone of interest should have already been fractured as the fluid pill approaches the zone of interest because the fluid pill is located at the tail end of the fracturing fluid.

The pumping, and thus displacement of the fracturing fluid, is stopped as the fluid pill reaches the perforation tunnels at the zone of interest. The fluid pill with a high concentration of sand remains stationary within the wellbore with the hope that the sand or proppant remains suspended in the fluid pill. The displacement of the fracturing fluid is stopped for a period of time to allow the fractures within the formation to partially close. Once partially closed, the displacement of the fluid pill is resumed, normally at a low rate in comparison to the pump rate during the fracturing process.

The fluid pill is pumped at a low rate moving the fluid pill into the perforation tunnels and into the fractures. Typically, the pump rate is set low enough to prevent the fractures from reopening. The pumping of the fluid in the wellbore causes the fluid of the fluid pill to enter the fractures, but the high concentration of sand or proppant suspended within the fluid pill screens out against the fractures because the fractures are partially closed. Subsequently, the suspended sand in the fluid pill begins to bridge off against the fractures. As the process continues, the sand continues to pack off against the perforation tunnels and eventually the sand packs off against itself creating a sand plug in the wellbore. The slow rate of pumping is continued until the pressure within the wellbore rises indicating that a proper sand plug has been built within the wellbore.

Building a sand plug within a horizontal wellbore is a difficult process because any gravitational settling of sand or proppant in the wellbore will leave a fluid channel at the top of the hole and subsequent pumping will simply allow sand free displacement fluid to pass down the 'channel" and into the fracture without allowing a sand plug to form. The fluid pill needs to remain stationary long enough to allow the fractures in the formation to at least partially close and so the fracturing fluid must suspend the sand or proppant for at least this period of time. If the sand does not remain suspended and settle out, it is likely that a proper sand plug will not be achieved. This is because, as the sand settles, clear fluid or fluid without suspended sand becomes located at the top of the horizontal wellbore. As pumping is resumed, the fluid of the fluid pill will simply stream over the sand bed rather than carrying the sand into the perforation tunnel because of the gap at the top of the horizontal bore.

Failing to build a sand/proppant plug will inevitably require a remedial operation involving a pump down wireline plug or a coiled tubing run.

Thus, it is critical that the sand remains suspended in the fluid pill while the fluid pill is stationary and/or being propagated adjacent the perforations. However, the sand and/or methods utilized in prior art isolation techniques have difficulty maintaining sand suspension, which leads to costly and time consuming workovers and cleaning jobs.

In light of the foregoing, it would be desirable to use an ultra lightweight proppant or neutrally buoyant proppant to build a sand plug within a wellbore. It would also be beneficial to provide a method of building a sand or proppant plug in a wellbore wherein a proppant may be used that remains suspended in a various fracturing fluids. It would also be desirable to provide a method of varying the density of proppant used in a fluid pill to build a sand plug within a wellbore as this allow a greater range of fracturing fluids that may be used in the fracturing process. It would also be desirable to provide a method of using a fluid pill containing a proppant that promotes screening out at the perforations such as using a proppant having a larger diameter than the proppant used in the fracturing process.

The present invention is directed to overcoming, or at least reducing the effects of, one or more of the issues set forth above.

SUMMARY OF THE INVENTION

In view of the foregoing, the present invention provides methods of building a plug within a horizontal wellbore to hydraulically isolate a portion of the wellbore. The method may include pumping a fluid pill into the horizontal wellbore at the tail end of a fracturing treatment used to fracture the formation at a zone of interest, the fluid pill containing a high concentration of an ultra lightweight proppant. The pumping of the displacement fluid pill down the wellbore is stopped as the pill reaches the zone of interest causing the fluid pill to be stationary within the wellbore. The pumping in the wellbore is stopped for long enough period of time to allow the fractures at the zone of interest to partially close. The use of an ultra lightweight proppant helps the proppant to remain suspended within the fluid pill while it is stationary within the wellbore. Alternatively, the fluid pill may include a high concentration of neutrally buoyant proppant or ultra lightweight proppant mixture comprising ultra lightweight proppant mixed with conventional fracturing proppant.

After the fractures have partially closed, the pumping is resumed at a low rate or as a short pump burst, thereby displacing the fluid pill towards the fractures. The fluid of the fluid pill enters into the fractures, but the ultra lightweight proppant may not because the fractures are partially closed and filled with the proppant from the fracturing process. This causes the ultra lightweight proppant to bridge off against the fractures and/or the perforations tunnels. In one embodiment, an ultra lightweight proppant having a larger diameter than the fracturing proppant is used. The larger diameter of the ultra lightweight proppant may promote the bridging off of the proppant. The continued pumping of the fluid within the wellbore may cause the ultra lightweight proppant to bridge off against itself until a plug is formed within the horizontal wellbore.

Figure 1:
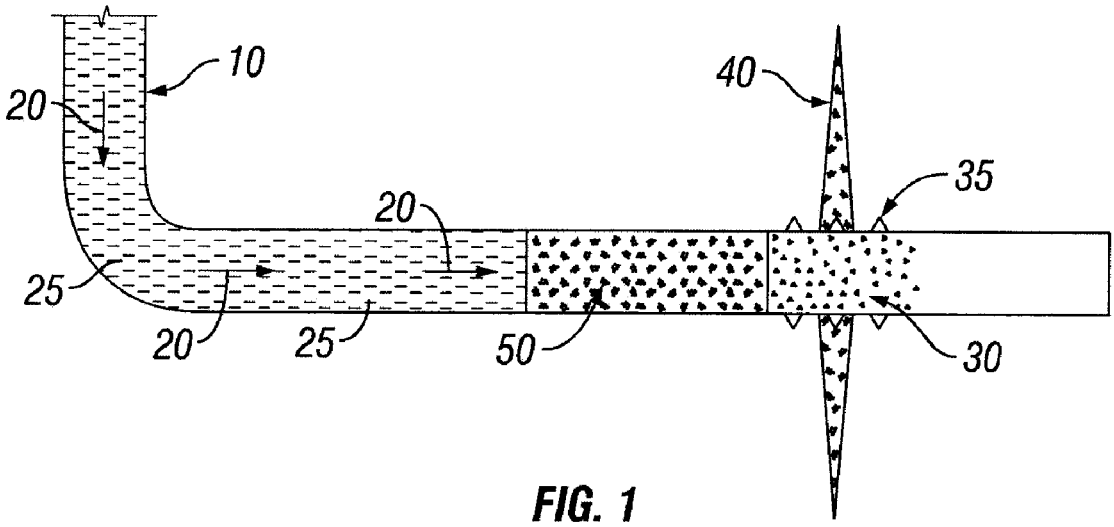
FIG. 1 shows a fluid pill located at the tail end of fracturing fluid being displaced down a horizontal wellbore, the fluid pill containing an elevated amount of ultra lightweight proppant according to an exemplary embodiment of the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments and methods of the present invention are described below as they might be employed in the use of ultra lightweight or neutrally buoyant proppant to build a sand plug in a horizontal wellbore. In the interest of clarity, not all features of an actual implementation are described in this specification. It will of course be appreciated that in the development of any such actual embodiment or method, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments of the invention will become apparent from consideration of the following description and drawings.

FIG. 1 illustrates a horizontal wellbore that includes a casing 10 that has been perforated 35. The casing 10 may have been perforated by a various number of methods as would be appreciated by one of ordinary skill in the art. A horizontal well, as used in this disclosure, refers to any deviated well. These wells can include, for example, any well which deviates from a true vertical axis more than 60 degrees. Those ordinarily skilled in the art having the benefit of this disclosure will understand that all such wells are encompassed by the term "horizontal well." The use of a cased horizontal wellbore in FIGS. 1-4 is for illustrative purposes only, as the disclosed invention is also applicable in horizontal open wellbores as would be recognized by one of ordinary skill in the art having the benefit of this disclosure.

According to an exemplary embodiment of the present invention, after the casing 10 has been perforated, fracturing fluid, including proppant 30, is pumped down the casing under high pressure creating fractures 40 in the well formation at the perforations 35 in the casing 10. A fluid pill 50 is located at the tail end of the proppant 30 and is displaced (denoted by 20 of FIGS. 1 & 3) down the horizontal wellbore by displacement fluid 25 pumped down the wellbore. Fluid pill 50 contains ultra lightweight proppant which remains substantially suspended while the fluid pill 50 is stationary within the horizontal wellbore, thereby bridging off and forming a plug with the horizontal wellbore. The concentration of ultra lightweight proppant within the fluid pill 50 is higher in comparison to the concentration of proppant 30 used in the fracturing fluid. For purposes of this disclosure, please note the terms "suspended" and "substantially suspended" are used interchangeably; as such, they could refer to ultra lightweight proppants and/or ultra lightweight proppant mixtures capable of partial or complete suspension.

The ultra lightweight proppant used in fluid pill 50 may be, for example, neutrally buoyant proppant; proppant that has approximately 50% the density of sand conventionally used as proppant in the fracturing of a well formation; some mixture of lightweight proppant and fracturing proppant; or some other proppant which is lighter than sand. The ultra lightweight proppant, for example, may have a specific gravity of 1.08 to 1.75. The density of the ultra lightweight proppant may be varied according to the fracturing fluid used in the process to ensure that the ultra lightweight proppant does not settle out of the fluid pill 50 while it is stationary within the wellbore. Those ordinarily skilled in the art having the benefit of this disclosure will realize that a variety of proppant mixtures with varying specific gravities and densities may be used within the scope of the present invention.

In one exemplary embodiment, such ultra lightweight proppant can be, for example, the neutrally buoyant particulate material disclosed in U.S. Pat. No. 6,364,018 entitled "Lightweight Methods and Compositions for Well Treating" issued Apr. 2, 2002 or in U.S. patent application Ser. No. 10/653,521 entitled "Method of Treating Subterranean Formations with Porous Ceramic Particulate Materials" filed Sep. 2, 2003 each being assigned to BJ Services Company. Likewise, the ultra lightweight proppant may be the neutrally buoyant particulate material disclosed in U.S. patent application Ser. No. 10/824,217 entitled "Method of Treating Subterranean Formations with Porous Ceramic Particulate Materials" filed Apr. 14, 2004. The above patent and patent applications disclose the use of a neutrally buoyant particulate material in the stimulation of a well. Each of the above patent and patent applications is incorporated herein incorporated by reference in its entirety.

In yet another exemplary embodiment, the ultra lightweight proppant in fluid pill 50 is a neutrally buoyant resin coated material that may be pumped downhole with the fluid pill 50 in order to bridges off against the formation to form a plug. There are numerous materials that may be used in this application as would be recognized by one of ordinary skill in the art having the benefit of this disclosure. For example, one type of neutrally buoyant resin coated material is LITEPROP™ offered by BJ Services Company of Houston, Tex. Additionally, a neutrally buoyant plastic such as divinylbenzene ("DVB") may be used in this application.

In yet another exemplary embodiment, fluid pill 50 contains a mixture of conventional fracturing proppant (such as, for example, Ottawa Sand) and ultra lightweight proppant. Such an ultra lightweight proppant mixture, for example, can be approximately 30% ultra lightweight proppant and approximately 70% fracturing proppant (such as, for example, Ottawa Sand) by total plug weight (owing to density differences this yields an approx 50/50 mix by volume). An alternative exemplary embodiment could use a 15/85 mixture of ultra lightweight proppant and conventional proppant by weight. The ultra lightweight proppant used herein could be FLEXSAND™, while the fracturing proppant could be conventional Ottawa sand, both products offered by BJ Services Company of Houston, Tex. Please note, however, that those ordinarily skilled in the art having the benefit of this disclosure will recognize that a variety of mixtures may be utilized within the scope of this invention. Besides sand, bauxite and other ceramic proppants (e.g. econoprop, carbolite, carboprop, interprop, etc.), other types of fracturing proppant that can be mixed with the ultra lightweight proppant include LITEPROP™ 108, LITEPROP™ 125, LITEPROP™ 175 and FLEXSAND™, all manufactured and marketed by BJ Services Company of Houston, Tex.

Figure 2:
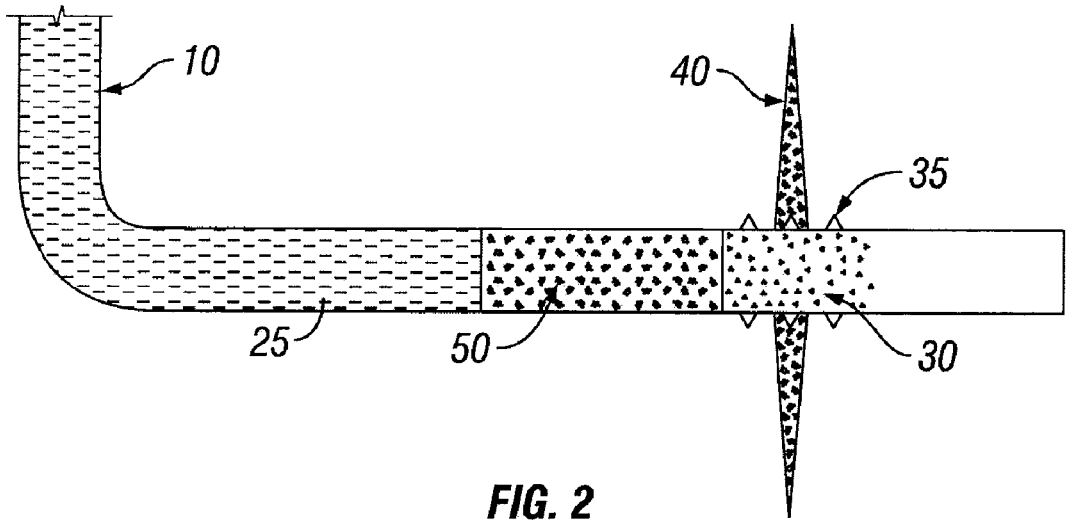
FIG. 2 shows the fluid pill stationary within the horizontal wellbore above the perforations at the zone of interest according to an exemplary embodiment of the present invention.

Further referring to the exemplary embodiment of FIG. 1, after the hydraulic pressure of the fracturing fluid fractures the formation, the proppant 30 located in the fracturing fluid enters the fractures 40 helping to hold the fractures open. The pumping of the fluid 25 in the wellbore is stopped or reduced as the fluid pill 50 approaches the perforations 35 in the casing 10 and the fluid pill 50 becomes stationary as shown in FIG. 2. Given the properties described above, the ultra lightweight proppant remains suspended within the fluid pill 50 while the fluid pill 50 is stationary within the wellbore.

The fluid pill 50 needs to remain stationary for a period of time long enough to allow the fractures 40 in the formation to partially close. The amount of time needed may vary depending on various factors, including the composition of the formation and various components of the fracturing fluid, such as the type and concentration of polymer in the fracturing fluid, the degree of crosslinking, amount of breaker, volumes of fluid used etc. Various computer models may be used to estimate the fracture closure time after the pumping has stopped as would be appreciated by one of ordinary skill in the art.

Figure 3:
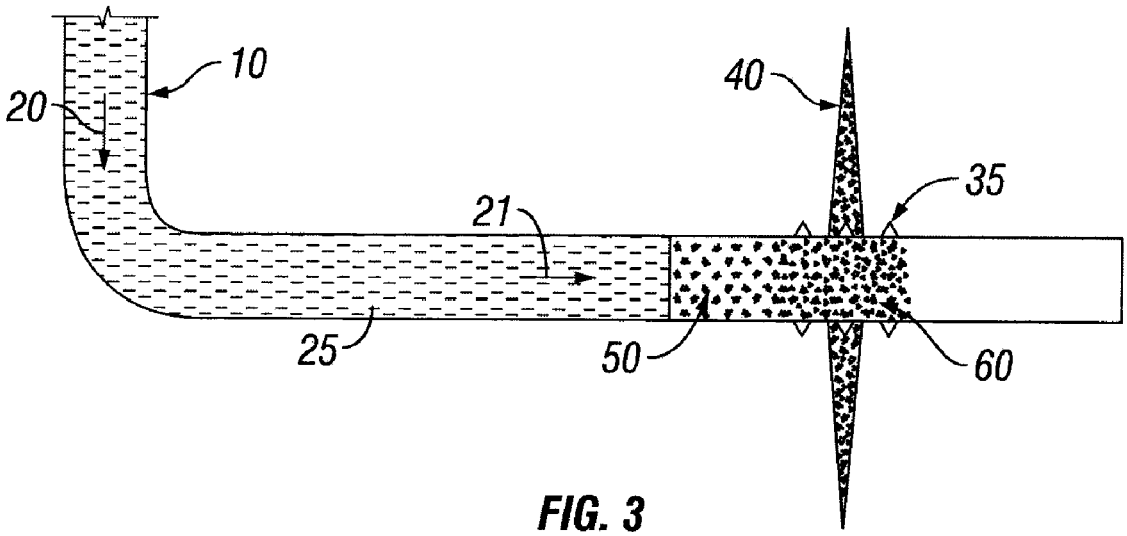
FIG. 3 shows the ultra lightweight proppant of a fluid pill beginning to bridge off at the zone of interest according to an exemplary embodiment of the present invention.
Figure 4:
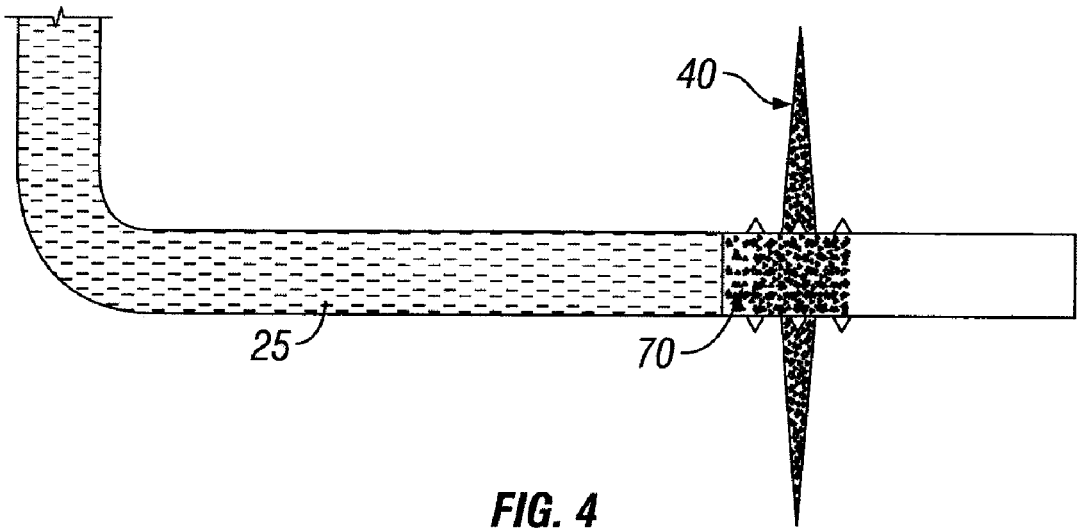
FIG. 4 shows a sand plug of ultra lightweight proppant isolating a zone of a horizontal wellbore according to an exemplary embodiment of the present invention.

Referring to FIGS. 3 and 4, once the fractures 40 have partially closed, the pumping of the displacement fluid 25 is varied based upon whether fluid pill 50 is comprised only of ultra lightweight proppant or comprised of an ultra lightweight proppant mixture. When fluid pill 50 is comprised of only ultra lightweight proppant, the pumping of displacement fluid 25 is resumed at a low rate, as shown by the arrows 21 in FIG. 3, to slowly displace the fluid pill 50 down the casing 10. The slow pumping rate of the displacement fluid 25 should be low enough to prevent the fractures 40 from reopening and should be at a rate lower than the pumping rate used during the fracturing process. The pumping rate can be adjusted based on the size of the casing, the length of the horizontal well and the size of the fluid pill in order to limit the amount of sand that is dropped out of the fluid pill 50 during placement. Those skilled in the art having the benefit of this disclosure realize there are any variety of computer models and methods by which this adjustment may be accomplished.

However, in the alternative, if fluid pill 50 is comprised of an ultra lightweight proppant mixture as described previously, the pumping of displacement fluid 25 may be resumed as a short pumping burst. This pumping burst rate, for example, may be the pumping rate used during fracturing operations. This short pump burst involves bringing the pump rate up from zero to substantially the fracturing rate as quickly as possible for a short duration. Once this is done, a rapid increase in pressure will be observed at the surface if the fluid pill 50 bridges off against the fracture. If no pressure increase is observed, then the fracture has not been plugged and the short pumping burst is repeated. However, once a sufficient pressure increase is observed, the fracture has been plugged as discussed below.

In either event, as the fluid pill 50 is slowly displaced (or displaced via a short pumping burst), the ultra lightweight proppant will be displaced towards the perforations 35 in the casing 10 and the fractures 40 in the formation. Since the fractures 40 are already partially closed and full of proppant 30 from the fracturing process, the ultra lightweight proppant is at least partially prevented from entering fractures 40. However, the water of the fluid pill 50 is able to flow into the fractures 40 causing the fluid pill 50 to dehydrate. As illustrated in FIG. 3, the dehydration of the fluid pill 50 in combination with the very slow pumping of the displacement fluid 25 causes the ultra lightweight proppant to begin to bridge off 60.

In yet another exemplary embodiment, in order to promote the bridging off of the ultra lightweight proppant, an ultra lightweight proppant may be selected having a larger diameter than the diameter of the proppant 30 used in the fracturing fluid. The larger diameter of the ultra lightweight proppant further prevents the entrance of the ultra lightweight proppant into the fractures 40 promoting the ultra lightweight proppant to bridge off 60 against itself. The use of larger diameter ultra lightweight proppants is made possible because they can be suspended just as easily as the smaller diameter sized material unlike conventional heavier weight proppants where large sized proppants settle much more quickly.

Referring to FIG. 4, as the displacement fluid 25 is slowly pumped (or displaced via the short pumping burst), the ultra lightweight proppant continues to bridge off until a plug 70 is built up in the wellbore. The displacement fluid 25 is continued to be pumped into the wellbore, which results in a pressure increase which can be detected by various means known in the art. Once a certain pressure increase is detected, an operator and/or other monitoring means will understand/determine this indicates the wellbore has been hydraulically isolated with the plug 70.

An exemplary method of the present invention includes pumping fluid down the horizontal wellbore to displace a fluid pill located at the tail end of fracturing fluid used to fracture the wellbore. The fluid pill includes a high concentration of ultra lightweight proppant in comparison to the amount of proppant in the fracturing fluid during the fracturing process. The proppant in the fluid pill may be a neutrally buoyant proppant or ultra lightweight proppant mixture. The method may further include stopping the pumping of fluid down the wellbore such that the fluid pill is stationary within the wellbore, thereby allowing the at least one fracture at the zone of interest to partially close. The fluid pill may be stationary within the wellbore at a location above a zone of interest, the zone of interest including at least one fracture formed by the fracturing fluid during the fracturing process.

The exemplary method may further include suspending the ultra lightweight proppant in the fluid pill while the fluid pill is stationary within the horizontal wellbore, restarting the pumping of the fluid down the horizontal wellbore at a very slow rate or via a short pumping burst to displace the fluid pill after the fluid pill has been stationary within the wellbore and preventing the ultra lightweight proppant of the fluid pill from entering the at least one fracture, wherein the ultra lightweight proppant bridges off against the wellbore and forms a plug.

In yet another exemplary method, once the fluid pill has been pumped downhole, the pumping rate of the fluid is reduced to a lower pumping rate, instead of completely stopping the pumping rate. This reduction is for a period of time sufficient enough to allow the fracture at the zone of interest to partially close by the time the fluid pill reaches the zone of interest. Upon reaching the zone of interest, the fluid pill may be slowly displace into the zone of interest causing the proppant to bridge off and form a plug within the wellbore.

The exemplary methods may further include continuing to pump fluid down the wellbore until the pressure rises within the wellbore, thereby indicating the well has been isolated. The method may also include varying the density of the ultra lightweight proppant, using an ultra lightweight proppant that has a larger diameter than the diameter of proppant used during the fracturing process, or utilizing a combination of ultra lightweight proppant and conventional fracturing proppant. The method may further include cleaning out the plug from the wellbore, wherein the proppant from the plug remains suspended during the cleanout process.

In yet another exemplary method, the method includes pumping fluid down a horizontal wellbore to displace a fluid pill down the wellbore. Ultra lightweight proppant or neutrally buoyant proppant is suspended within the fluid pill as the fluid pill is pumped down the wellbore. The use of ultra lightweight proppant or neutrally buoyant proppant may allow the fluid pill to be pumped down coiled tubing and placed at a desired location within a wellbore. The stability of ultra lightweight proppant and neutrally buoyant proppant allows a fluid pill suspending either of these proppants to be pumped through coiled tubing and into the wellbore without the risk that the proppant will settle out. Once the fluid pill is within the wellbore, the fluid pill may be slowly displace into the zone of interest causing the suspended proppant to bridge off and form a plug within the wellbore.

Although various embodiments have been shown and described, the invention is not so limited and will be understood to include all such modifications and variations as would be apparent to one skilled in the art. Accordingly, the invention is not to be restricted except in light of the attached claims and their equivalents.

What is claimed is:

1. A method for building a plug in a horizontal wellbore, the method comprising the steps of:

(a) pumping a fracturing fluid into the horizontal wellbore;

(b) suspending ultra lightweight proppant within a fluid pill, the ultra lightweight proppant being capable of remaining suspended in various types of fluids;

(c) pumping a displacement fluid down the wellbore to displace the fluid pill;

(d) varying a pumping rate of the displacement fluid such that at least one fracture in a zone of the horizontal wellbore is allowed to partially close, the ultra lightweight proppant remaining suspended within the fluid pill;

(e) pumping the fluid down the horizontal wellbore to slowly displace the fluid pill after the at least one fracture in the zone has partially closed; and (f) at least partially preventing the ultra lightweight proppant from entering the at least one fracture in the zone, wherein the ultra lightweight proppant bridges off forming a plug within the wellbore.

2. A method as defined in claim 1, wherein step (d) further comprises the step of stopping the pumping of the displacement fluid before the fluid pill reaches the zone, wherein the fluid pill is stationary within the wellbore.

3. A method as defined in claim 2, the method further including the step of varying a density of the ultra lightweight proppant such that the ultra lightweight proppant does not settle out while the fluid pill is stationary.

4. A method as defined in claim 1, the method further comprising the step of continuing to pump the fluid down the wellbore until a pressure rises within the wellbore.

5. A method as defined in claim 1, wherein step (b) comprises utilizing an ultra lightweight proppant that has a larger diameter than a diameter of a proppant used during fracturing of the wellbore.

6. A method as defined in claim 1, the method further comprising the step of cleaning out the plug from the wellbore, the ultra lightweight proppant remaining suspended during the cleaning.

7. A method as defined in claim 1, wherein step (b) comprises utilizing ultra lightweight proppant comprising a mixture of the ultra lightweight proppant and a fracturing proppant.

8. A method as defined in claim 1, wherein the ultra lightweight proppant is neutrally buoyant.

9. A method for building a sand plug in a horizontal wellbore comprising:

(a) suspending ultra lightweight proppant within a fluid pill;

(b) pumping displacement fluid down the wellbore to displace the fluid pill;

(c) allowing at least one fracture in a zone of the horizontal wellbore to partially close;

(d) pumping the displacement fluid down the horizontal wellbore to slowly displace the fluid pill after the at least one fracture in the zone has partially closed; and (e) at least partially preventing the ultra lightweight proppant from entering the at least one fracture in the zone, wherein the ultra lightweight proppant bridges off forming a plug within the wellbore.

10. A method as defined in claim 9, wherein step (c) further includes the step of stopping the pumping of the displacement fluid before the fluid pill reaches the zone, wherein the fluid pill is stationary within the wellbore.

11. A method as defined in claim 10, wherein the ultra lightweight proppant remains suspended within the fluid pill while the fluid pill is stationary within the wellbore.

12. A method as defined in claim 9, wherein the ultra lightweight proppant is a neutrally buoyant resin coated material.

13. A method as defined in claim 9, wherein step (c) further includes the step of reducing a pumping rate of the fluid such that the at least one fracture in the zone partially closes.

14. A method as defined in claim 9, the method further comprising the step of continuing to pump the displacement fluid down the wellbore until a pressure rises within the wellbore.

15. A method as defined in claim 9, the method further including the step of varying a density of the ultra lightweight proppant such that the ultra lightweight proppant does not settle out while the fluid pill is stationary.

16. A method as defined in claim 9, wherein step (a) comprises utilizing an ultra lightweight proppant that has a larger diameter than a diameter of a proppant used during fracturing of the wellbore.

17. A method as defined in claim 9, the method further comprising the step of cleaning out the plug from the wellbore, the ultra lightweight proppant remaining suspended during the cleaning.

18. A method as defined in claim 9, wherein step (a) comprises utilizing a mixture of the ultra lightweight proppant and a fracturing proppant.

19. A method of using an ultra lightweight proppant in forming a plug within a horizontal wellbore, the method comprising the steps of:

(a) suspending ultra lightweight proppant within a fluid pill, the ultra lightweight proppant capable of remaining suspended while fluid pill is pumped through the horizontal wellbore;

(b) pumping the fluid pill through the horizontal wellbore to a location adjacent a zone in the wellbore, (c) varying a pumping rate of the fluid pill in order to allow a fracture extending from the zone to partially close, the ultra lightweight proppant remaining suspended within the fluid pill; and (d) plugging the zone using the ultra lightweight proppant.

20. A method as defined in claim 19, wherein the ultra lightweight proppant is a neutrally buoyant resin coated material or ultra lightweight proppant mixture.

21. A method as defined in claim 19, the method further comprising the step of cleaning out the plug from the wellbore, the ultra lightweight proppant remaining suspended during the cleaning.

22. A method as defined in claim 19, wherein step (a) the fluid pill is pumped through a coiled tubing.

23. A method as defined in claim 19, wherein step (d) comprises the step of applying a short pumping burst to displace the fluid pill after the fracture extending from the zone has partially closed, the fluid pill being comprised of an ultra lightweight proppant mixture.

24. A method for building a sand plug in a horizontal wellbore comprising:

(a) suspending ultra lightweight proppant within a fluid pill;

(b) displacing the fluid pill;

(c) allowing at least one fracture in a zone of the horizontal wellbore to partially close;

(d) continuing to displace the fluid pill after the at least one fracture in the zone has partially closed; and (e) preventing the ultra lightweight proppant from entering the at least one fracture in the zone, wherein the ultra lightweight proppant bridges off forming a plug within the wellbore.

* * * * *